US006648450B2

(12) United States Patent
Takahashi

(10) Patent No.: US 6,648,450 B2
(45) Date of Patent: Nov. 18, 2003

(54) INK EJECTABILITY MAINTENANCE DEVICE AND RECORDING APPARATUS INCORPORATING THE SAME

(75) Inventor: Nobuhito Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 10/123,525

(22) Filed: Apr. 17, 2002

(65) Prior Publication Data

US 2002/0163554 A1 Nov. 7, 2002

(30) Foreign Application Priority Data

Apr. 17, 2001 (JP) ..... P2001-118742

(51) Int. Cl.[7] ..... B41J 2/165
(52) U.S. Cl. ..... 347/33
(58) Field of Search ..... 347/33, 29, 32; 15/250.361, 256.5; 101/155; 400/702

(56) References Cited

U.S. PATENT DOCUMENTS 6,155,667 A * 12/2000 Eckard et al. ..... 347/33

FOREIGN PATENT DOCUMENTS

JP 11-138830 5/1999

* cited by examiner

*Primary Examiner*—Shih-wen Hsieh
(74) *Attorney, Agent, or Firm*—Sughrue Mion, PLLC

(57) ABSTRACT

An ink ejectability maintenance device maintains an ink ejectability of at least one recording head which ejects ink droplets to a recording medium. A first wiper wipes a nozzle formation face of the recording head in a first direction. A second wiper wipes the nozzle formation face in a second direction which is different from the first direction. The first direction is a direction in which the recording head reciprocately moves, and the second direction is a direction in which the recording medium is fed. The first wiper and the second wiper are disposed on a single base member.

11 Claims, 10 Drawing Sheets

INK EJECTABILITY MAINTENANCE DEVICE AND RECORDING APPARATUS INCORPORATING THE SAME

BACKGROUND OF THE INVENTION

The present invention relates to an ink ejectability maintenance device for maintaining constant ink ejectability of a recording head for ejecting ink droplets toward a recording medium, as well as to a recording apparatus equipped with the ink ejectability maintenance device.

An ink jet printer, which is one example of the recording apparatus, is usually equipped with a print head mounted on a carriage which travels back and forth in a main scanning direction, and a medium feeder for intermittently feeding a recording medium, such as print paper, in a sub-scanning direction in preset increments. The print head is actuated in the main scanning direction while the recording medium is being fed in the sub-scanning direction, and ink droplets are ejected toward the recording medium from the print head.

A mono-color ink jet printer is usually equipped with one print head. In contrast, a full-color ink jet printer is equipped with a black-ink print head for ejecting black ink, and a plurality of color-ink print heads for ejecting various colors of ink, such as yellow, cyan, and magenta.

A print head of an ink jet printer of such a construction has a pressure generation chamber and a nozzle orifice communicated therewith. Ink is stored in a pressure generation chamber and pressurized at a predetermined pressure, whereby ink droplets of controlled size are ejected from the nozzle orifice to the recording medium. Accordingly, when variations arise in the ink ejectability of the nozzle orifice of the print head, the quality of a recorded image is greatly affected. Hence, the ink ejectability must be maintained constant at all times.

The ink ejectability is changed by various phenomena, such as an increase in viscosity or solidification due to evaporation or drying of solvent in ink by way of the nozzle orifice, clogging due to solid material, adhesion of dust to the nozzles, and intrusion of air bubbles into ink. In order to prevent occurrence of such a change in characteristic, the ink jet printer is equipped with an ink ejectability maintenance device which eliminates the above-described phenomena causing variations to maintain the ink ejectability constant.

The ink ejectability maintenance device is equipped with a capping device, a suction pump, and a wiping device. The capping device is arranged so as to seal a nozzle formation face of a print head when no recording operation is performed, thereby isolating the nozzle orifice from the outside. Thus, the ink ejectability maintenance device has the function of inhibiting evaporation and drying of ink, thereby hindering an increase in viscosity and solidification of ink. Even when the nozzle formation face is sealed with the capping device, there cannot be completely prevented occurrence of clogging due to solid material in the nozzle orifice or intrusion of air bubbles into an ink flow channel. The ink jet printer is further equipped with a suction pump for the purpose of completely preventing occurrence of these problems.

The suction pump is configured so as to exert negative pressure on the nozzle orifice while the nozzle formation face is sealed with the capping device. The suction pump has the function of forcefully causing ink to be discharged from the nozzle orifice through suction, thereby eliminating solid material or air bubbles. Forceful discharge of ink to be performed by the suction pump is usually carried out when a recording operation is resumed after the ink jet printer has remained inoperative for a long time period or when the user has actuated a specifically-designed switch provided in a control panel with the understanding that deterioration of recorded image quality.

When ink is forcefully discharged by the suction pump, ink may splash across a nozzle formation face of the printer head, and in each nozzle orifice an ink meniscus may be disturbed. The nozzle formation face of the print head becomes susceptible to adhesion of extraneous matter with lapse of time. Hence, the print head is equipped with a wiping device for wiping the nozzle formation face, as required.

The wiping device has a wiping member whose base end is caught by a holder, and is constituted of an elastic plate such as rubber. An edge of the extremity of the wiping member is elastically pressed against a nozzle formation face, thereby effecting relative reciprocal movement so as to wipe the nozzle formation face. As a result, ink or extraneous matter adhering to the nozzle formation face is wiped, and ink meniscuses of respective nozzle orifices are made uniform. In short, the wiping device has the function of making the nozzle formation face stable.

The wiping device performs two types of wiping methods: a so-called horizontal wiping method and a so-called vertical wiping method. According to the horizontal wiping method, a wiper is set, and the print head is actuated in a printing direction: that is, a main scanning direction, thus wiping the nozzle formation face. According to the vertical wiping method, a print head is fixed, and a wiper is actuated in a paper feeding direction: that is, a sub-scanning direction, thus wiping the nozzle formation face. An appropriate wiping method is selected according to the type of ink: that is, dye, pigment, or reactive ink; the layout of a nozzle of a print head; or concentrated layout of a plurality of color nozzles on a print head with respect to either the main or sub-scanning direction.

When an attempt is made to apply any one of the wiping methods to one print head, there may arise a case where ink remains on either side of the print head, thereby soiling print paper. There has recently been proposed an ink jet printer equipped with one print head for ejecting only black ink and another print head on which nozzles for ejecting cyan ink, magenta ink, and yellow ink are arranged in the sub-scanning direction, wherein the two print heads are arranged side by side in the main scanning direction.

However, when such an ink jet printer employs ink which may coagulate when different colors of ink are mixed together, the two print heads cannot be wiped horizontally, because they are arranged side by side in the main scanning direction. Moreover, the cyan nozzles, the magenta nozzles, and the yellow nozzles are arranged in the sub-scanning direction, and hence the nozzles cannot be wiped vertically.

SUMMARY OF THE INVENTION

It is therefore an object of the present invention to provide an ink ejectability maintenance device having a wiping unit capable of completely wiping ink without involvement of mixing of different colors of ink, as well as a recorder having the ink ejectability maintenance device.

In order to achieve the above object, according to the present invention, there is provided an ink ejectability maintenance device for maintaining an ink ejectability of at least one recording head which ejects ink droplets to a recording medium, comprising:

a first wiper, which wipes a nozzle formation face of the recording head in a first direction; and a second wiper, which wipes the nozzle formation face in a second direction perpendicular to the first direction.

Preferably, the first direction is a direction in which the recording head reciprocately moves, and the second direction is a direction in which the recording medium is fed.

Preferably, the first wiper and the second wiper are disposed on a single base member.

According to the above configurations, a recording apparatus having only one recording head can be subjected to two-way wiping action. Hence, ink can be wiped off completely without involvement of residues. In the case of a recording apparatus in which two recording heads are disposed side by side in the main scanning direction and a plurality of color nozzles are provided on one of the recording heads in the sub-scanning direction, even when there is used ink which would coagulate when colors of ink are mixed together, the respective recording heads can be wiped by changing the wiping direction. Hence, colors of ink can be wiped completely without mixing of ink.

Preferably, the first wiper extends in a direction which is slightly angled from the second direction, and the second wiper extends in a direction which is slightly angled from the first direction.

In this device, the two wipers can alternatively wipe only one print head of an ink-jet printer without interfering with each other. In addition, the load fluctuations acting on a carriage for moving the recording during the wiping operation can be decreased.

Preferably, the at least one recording head includes a first recording head for ejecting ink droplets of plural colors and a second recording head for ejecting ink droplets of a single color, which are arranged in the first direction. Here, the first wiper wipes a nozzle formation face of the first recording head, and the second wiper wipes a nozzle formation face of the second recording head.

In this device, even when there is used ink which would coagulate when colors of ink are mixed together, the respective recording heads can be wiped by changing the wiping direction. Hence, colors of ink can be wiped completely without mixing of ink.

Preferably, the ink ejectability maintenance device further comprises a driver unit which moves the single base member only in the second direction.

In this device, the number of parts can be reduced.

Here, it is preferable that the driver unit includes a pair of planetary gears which transmits a driving force thereof to the base member, and a single rotor which rotates either one of the planetary gears so that the driving force is transmitted by both of a forward rotation and a reverse rotation thereof.

Here, it is preferable that the driver unit includes a sun gear meshed with the respective planetary gears and a partially-chipped gear connected to the base member. The partially-chipped gear includes a cog portion which meshes either one of the planetary gears when the base member is moved, and a cogless portion which faces either one of the planetary gears after the base member is moved.

In this device, the position of the wiper can be readily initialized. Hence, there is obviated a necessity for effecting a sensing operation by setting a flag for detecting an initial position of the wipers on a cam for actuating the wiper. Hence, an attempt can be made to facilitate adjustment and assembly of the ink ejectability maintenance device and to curtail costs of the device. The wipers can be positioned in a predetermined location reliably by rotating the partially-chipped gear to a cogless portion through use of a planetary gear through a predetermined angle.

Here, it is preferable that the partially-chipped gear is a four-gears unit which respectively meshes the respective planetary gears and a wiper gear for driving the base member.

In this device, rotations of the respective planetary gears can be transmitted to the wiper gear without fail, and hence the positioning precision of the wipers can be improved.

Here, it is preferable that the wiper gear includes a lever for moving the base member in the second direction and a cam mechanism connected to the lever.

According to the present invention, there is also provided a recording apparatus comprising the above ink ejectability maintenance device.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An embodiment of the invention will be described hereinbelow in detail by reference to the accompanying drawings.

Figure 1:
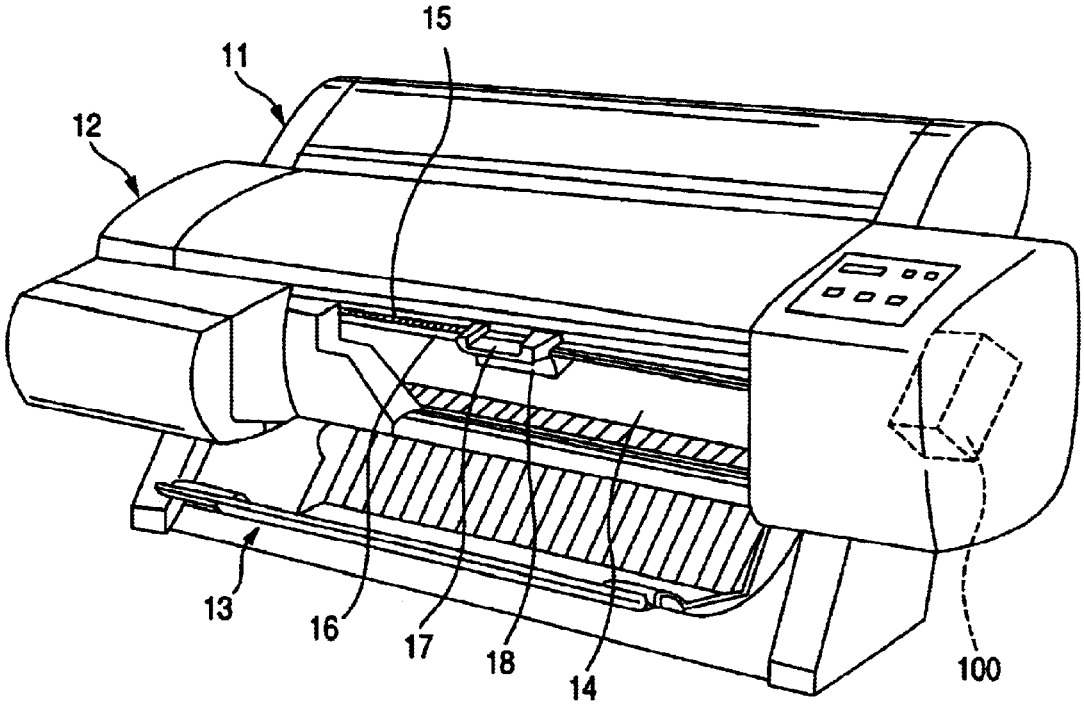
FIG. 1 is a perspective view showing the whole configuration of an ink jet printer according one embodiment of the invention.

An ink jet printer shown in FIG. 1 is a large printer capable of printing data onto print paper of relatively large size; e.g., paper of 594 mm (JIS A1-size paper) or paper of 728 mm (JIS B1-size paper).

In the ink jet printer, a paper feed section 11, a recording section 12, and a paper discharge section 13 are aligned so as to be parallel and to assume a diagonal relationship; specifically, the lower paper discharge section 13 is located closer to the operator than is the upper paper feed section 11. Print paper is discharged outside after having been subjected to predetermined printing during the course of being supplied from the paper feed section 11 to the paper discharge section 13 by way of the recording section 12. A paper transporting path 14 constituted at the time of printing is formed at an inclination of, e.g., 65 degrees, with respect to a horizontal plane. A nozzle formation face of a print head 18 mounted on a carriage 17, which travels back and forth in the main scanning direction along a guide shaft 16 by a driving belt 15, is provided at an angle of, e.g., 65 degrees, so as to become parallel with the paper transporting path 14.

An ink ejectability maintenance device 100 for maintaining the ink ejectability of the print head 18 constant is disposed in a position which serves as the home position of the carriage 17. While the carriage 17 is situated at the home position, the ink ejectability maintenance device 100 performs an operation for maintaining the ink ejectability of the print head 18.

Figure 2:
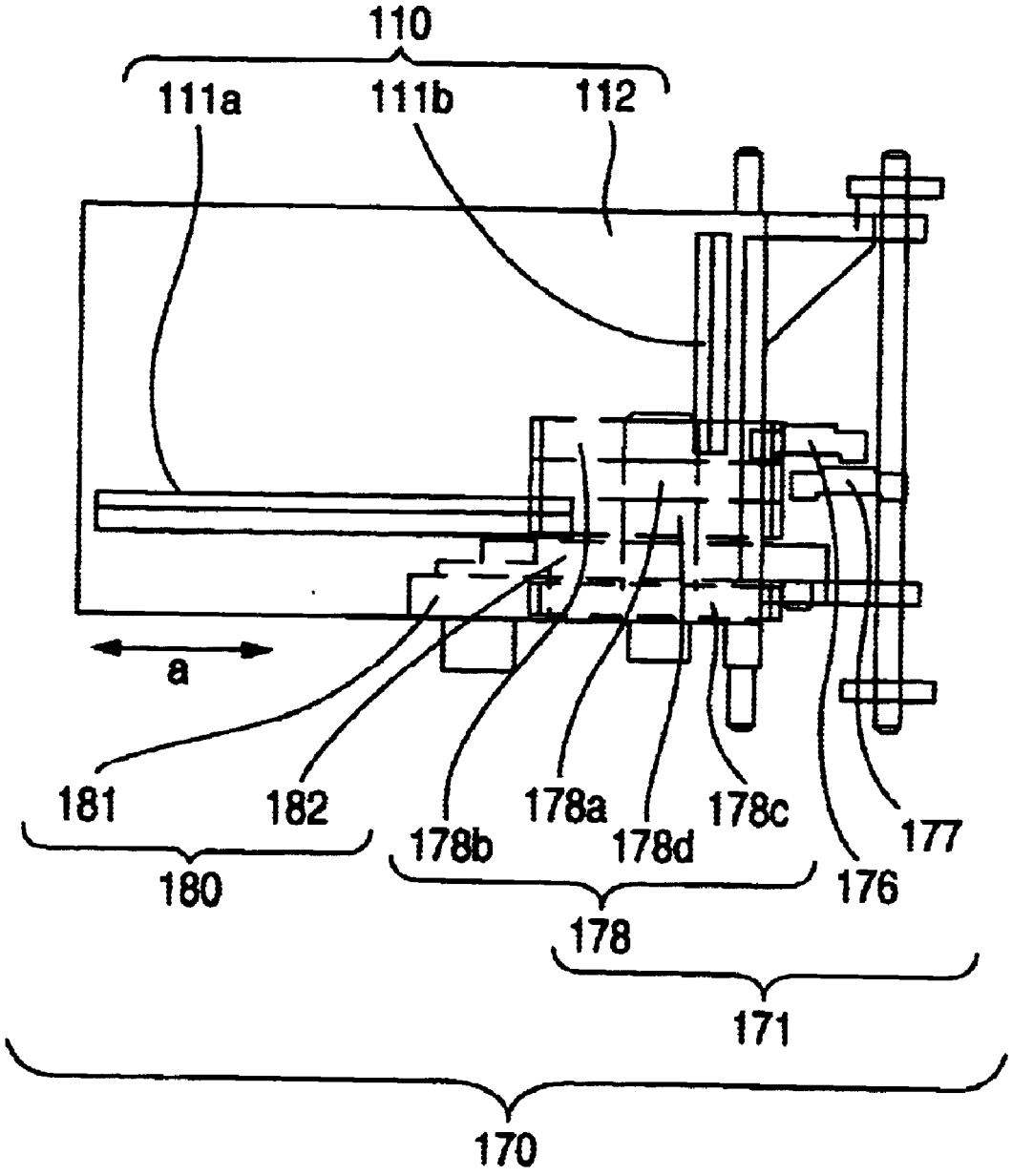
FIG. 2 is a plan view showing a wiping unit and a driving unit in an ink ejectability maintenance device according to the embodiment.
Figure 3:
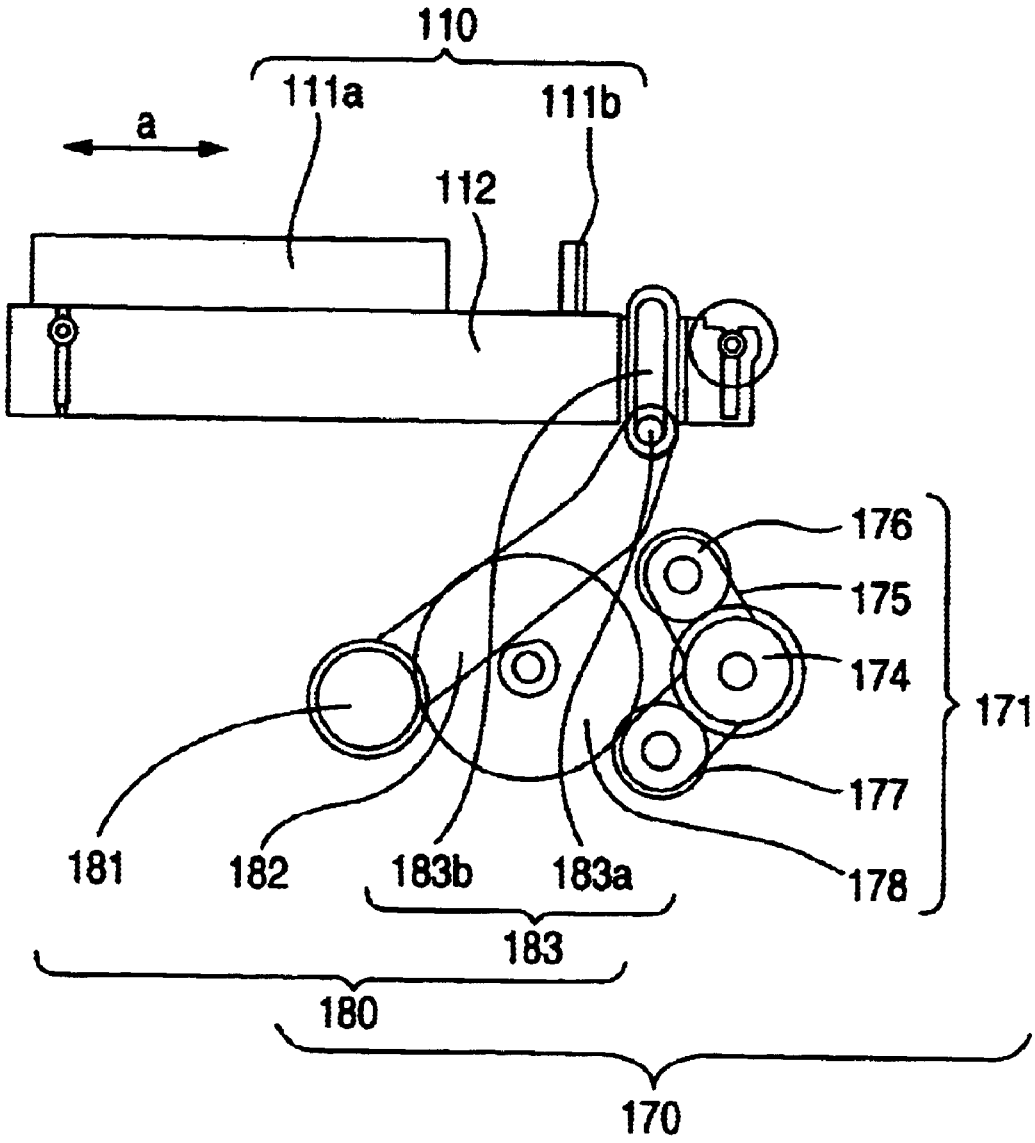
FIG. 3 is a side view of the wiping unit and the driving unit shown in FIG. 2.

As shown in FIGS. 2 and 3, the ink ejectability maintenance device 100 has a wiping unit 110 for wiping a nozzle formation face and a driving unit 170 for driving the wiping unit 110, as required. The wiping unit 110 has two wipers 111*a*, 111*b* and a wiper holder 112. The first wiper 111*a* is for horizontal wiping purpose and wipes the print head 18 by actuating the head in a printing direction: that is, the main scanning direction. The second wiper 111*b* is for vertical wiping purpose and wipes the print head 18 by moving in the paper feed direction: that is, the sub-scanning direction while the print head 18 is kept stationary.

By such a configuration, an ink jet printer having only one print head 18 can be subjected to two-way wiping actions, thereby enabling complete wiping of ink without involvement of residues.

Figure 4A:
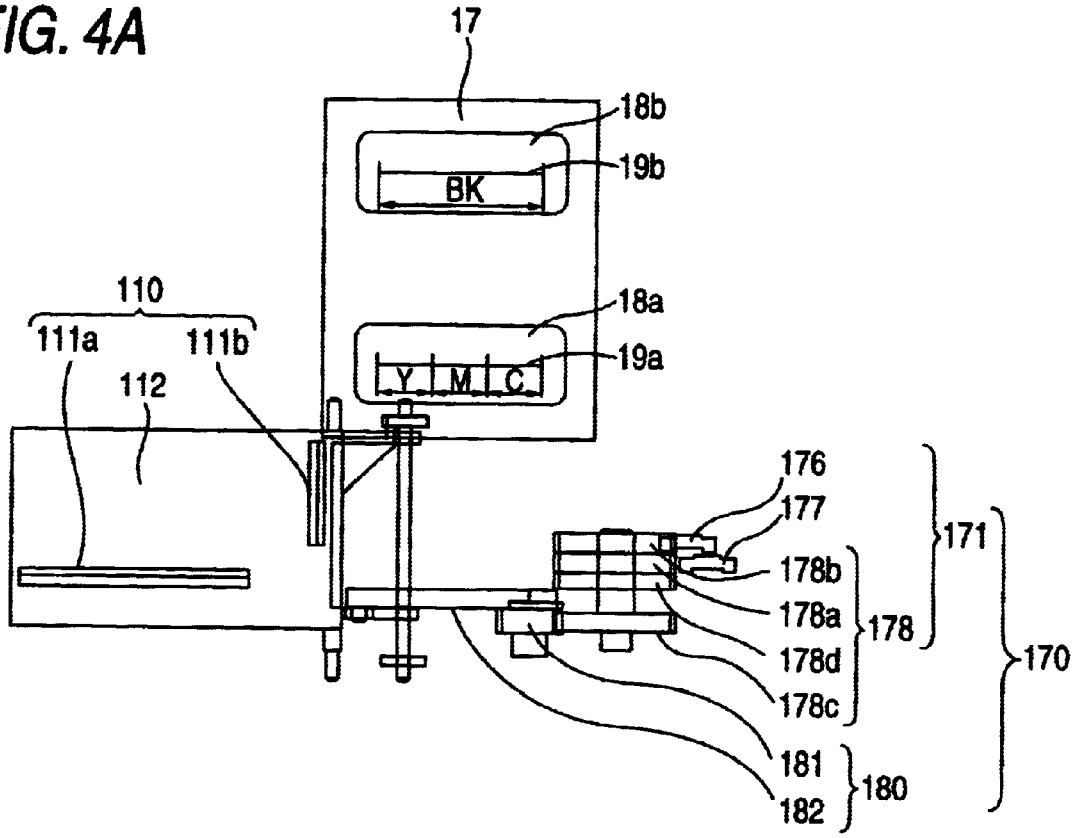
FIGS. 4A through 10B are views showing the operation of the ink ejectability maintenance device shown in FIG. 2.
Figure 4B:
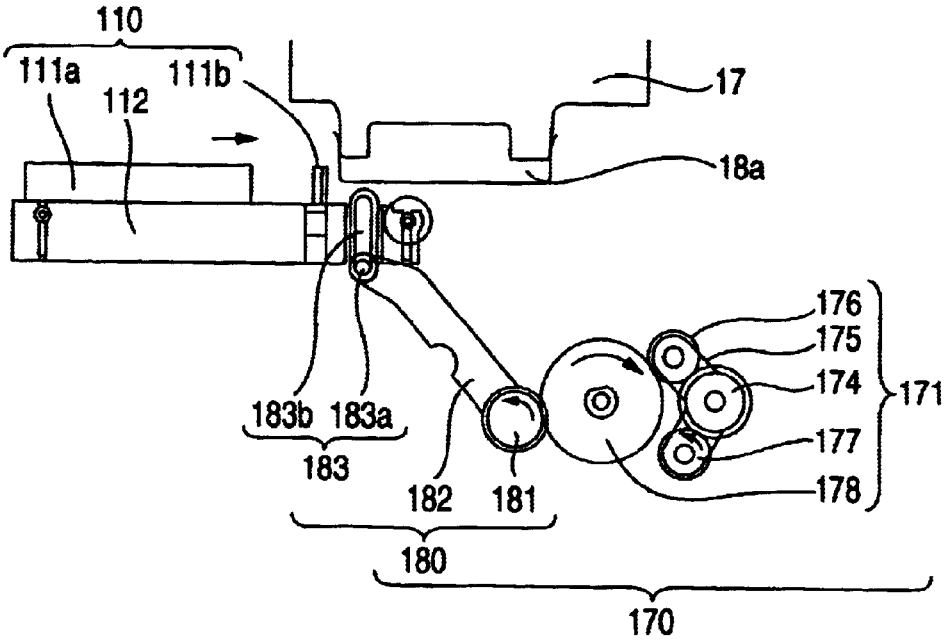

As shown in FIGS. 4A and 4B, there is a case where two print heads 18*a*, 18*b* are arranged side by side in the main scanning direction. Colors of nozzles 19*a*; e.g., a cyan (C) nozzle, a magenta (M) nozzle, and a yellow (Y) nozzle, are arranged on the print head 18*a* in the sub-scanning direction. Only a black nozzle 19*b* is provided on the remaining print head 18*b*. Even when ink which would coagulate when different colors of ink are mixed is used in such an ink jet printer, the print heads 18*a*, 18*b* can be wiped by changing wiping directions. Hence, ink can be wiped off completely without involvement of mixing of colors of ink. Even three or more print heads can be wiped by changing a wiping direction in accordance with layout of nozzles.

The wipers 111*a* and 111*b* are formed from rubber into the shape of a substantially-rectangular plate. The respective extremities of the wipers are brought into slidable contact with the nozzle formation face of the print head 18. The wiper 111*a* extends in a direction slightly angled from the sub-scanning direction, and the wiper 111*b* extends in a direction slightly angled from the main scanning direction. Accordingly, the load fluctuations acting on the carriage during the wiping operation can be decreased.

The two print heads 18*a*, 18*b* are arranged side by side in the main scanning direction. The color nozzles 19*a*: that is, a cyan (C) nozzle, a magenta (M) nozzle, and a yellow (Y) nozzle, are arranged on the print head 18*a* in the sub-scanning direction. Only the black (K) nozzle 19*b* is provided on the other print head 18*b*. In such an ink jet printer, after the print head 18*a* has been wiped with the first wiper 111*a*, the first wiper 111*a* is situated in an intermediate position between the two print heads 18*a*, 18*b*. The remaining print head 18*b* can be wiped with the second wiper 111*b*. Thus, the efficiency of wiping operation can be improved. Depending on the kind of ink, the wipers 111*a*, 111*b* may be formed from felt or plastic.

The wiper holder 112 is formed from plastic into the shape of a substantially-rectangular plate. The wiper holder 112 is actuated in the direction designated by arrow "a" shown in FIGS. 2 and 3 by a wiper actuator 180 which constitute the driving unit 170 to be described later, while holding the wipers 111*a*, 111*b* such that the extremities of the wipers 111*a*, 111*b* project from their upper portion of the wiper holder 112.

As shown in FIGS. 2 and 3, the driving unit 170 is equipped with a switcher 171 and the wiper actuator 180. The switcher 171 is provided with a sun gear 174 provided coaxial with the shaft of an unillustrated torque transmission gear; a forward rotation planetary gear 176 and a reverse rotation planetary gear 177 provided in a substantially-L-shaped planetary lever 175 so as to mesh with the sun gear 174; and a partially-chipped gear 178 capable of meshing with the planetary gears 176, 177.

The partially-chipped gear 178 is constituted of the forward rotation planetary gear 176, the reverse rotation planetary gear 177, and first through fourth partially-chipped gear 178*a*, 178*b*, 178*c*, and 178*d* which mesh with the wiper gear 181 constituting the wiper actuator 180 to be described later. In accordance with the rotating direction of the torque transmission gear for transmitting torque of a motor (not shown): that is, the rotating direction of the motor, either the forward rotation planetary gear 176 or the reverse rotation planetary gear 177 is meshed with the first partially-chipped gear 178*a* or the second partially-chipped gear 178*b*, thereby transmitting torque by way of the sun gear 174.

The wiper actuator 180 is provided with a wiper gear 181, a lever 182, and a cam mechanism 183. The wiper gear 181 is arranged to mesh with the third partially-chipped gear 178*c*. The cam mechanism 183 is constituted of a pin 183*a* formed integrally with one side face of the lever 182 and a groove 183*b* formed in the wiper holder 112. One end of the lever 182 is locked as a result of the pin 183*a* being inserted into the groove 183*b*. The other end of the lever 182 is arranged coaxially with the wiper gear 181.

By such a construction, the torque of the motor is transmitted from the torque transmission gear to the forward rotation planetary gear 176 which meshes with the planetary lever 175 because of its rotation, by way of the sun gear 174. Alternatively, the torque is transmitted from the reverse rotation planetary gear 177 to the first partially-chipped gear 178*a* or the second partially-chipped gear 178*b* and further to the wiper gear 181 by way of the third partially-chipped gear 178*c* and the fourth partially-chipped gear 178*d*. As a result, the wiping unit 110 can be actuated vertically.

The operation of the ink ejectability maintenance device 100 having the wiping unit 110 and the actuator 170, which have the foregoing constructions, will now be described by reference to FIGS. 4 through 10. As shown in FIGS. 4A and 4B, in an initial state the carriage 17 having the print heads 18*a*, 18*b* mounted thereon is situated in a position away from the path along which the wiping unit 110 is to travel. The wiping unit 110 is located in the leftmost position in the drawing.

When the planetary lever 175 is pivoted in this state as a result of the motor rotating forwardly, the forward rotation planetary gear 176 meshes with the first partially-chipped gear 178*a*. Torque of the sun gear 174 is transmitted from the forward rotation planetary gear 176 to the first partially-chipped gear 178*a* and from the third partially-chipped gear 178*c* to the wiper gear 181. As a result of pivotal movement of the lever 182, the wiper holder 112 starts moving in the rightward direction in the drawing by the cam mechanism 183.

Figure 5A:
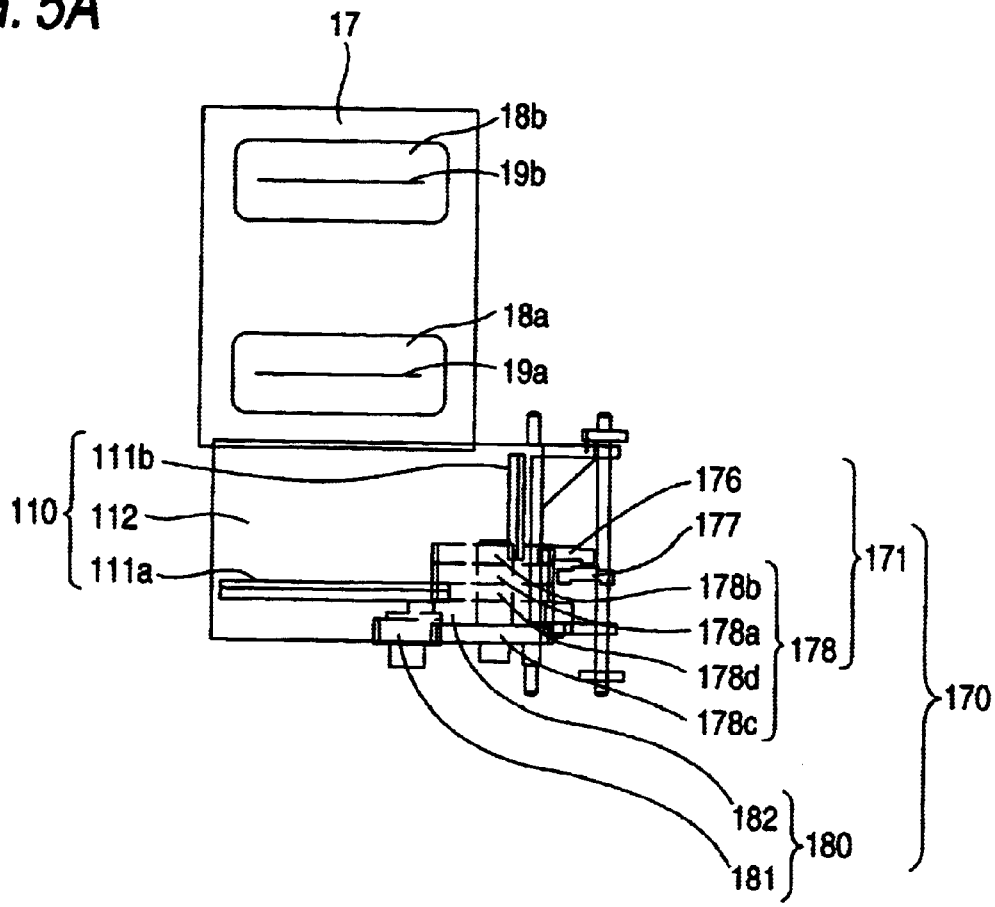
Figure 5B:
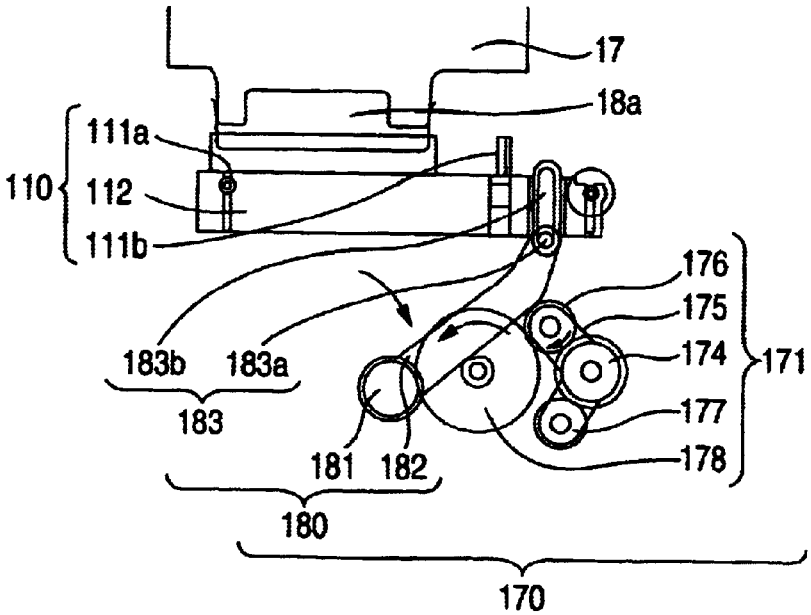

When the wiper gear 181 has reached a cog-chipped portion of the third partially-chipped gear 178*c*, thereby releasing the gear 181 from a meshed state, the wiper gear 181 idly rotates. As shown in FIG. 5, the wiper holder 112 stops moving. At this time, the wiping unit 110 is situated in the rightmost position in the drawing, and the wiper 111*a* is in a "set" state: that is, a state in which the wiping unit 110 can wipe the print head 18*a*.

Figure 6:
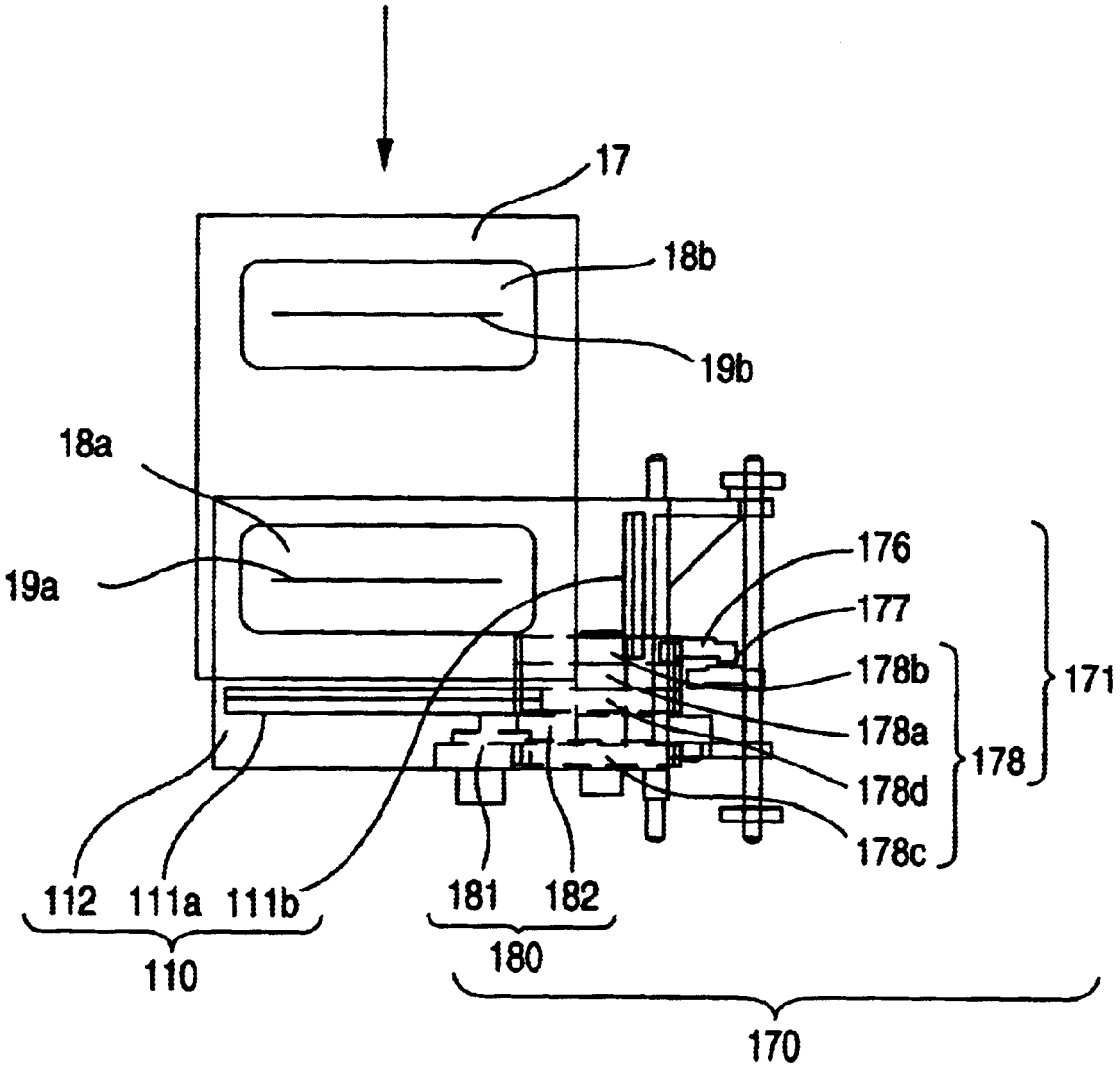
Figure 7:
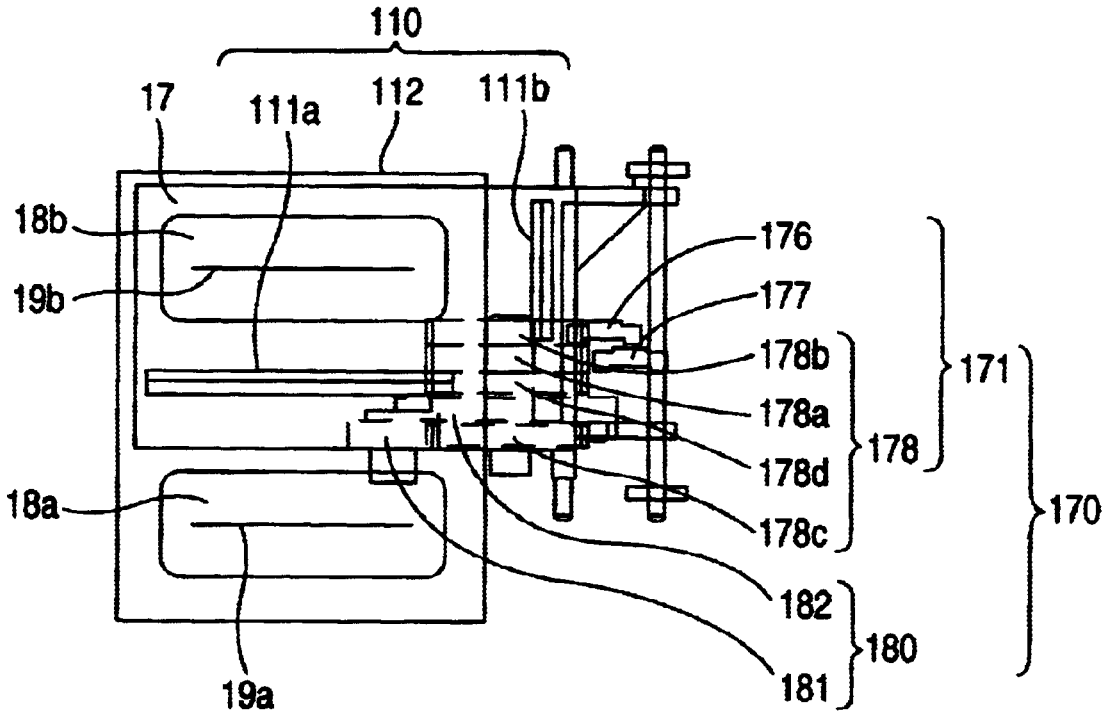

As shown in FIG. 6, in this state the carriage 17 having the print heads 18*a*, 18*b* mounted thereon is moved downward in the drawing. As a result, the wiper 111*a* can wipe a nozzle formation face of only the print head 18*a*. As shown in FIG. 7, movement of the carriage 17 is stopped, and at this time the wiper 111*a* is situated in the intermediate position between the print heads 18*a*, 18*b*. The wiper 111*a* is in a "reset" state: that is, a state in which wiping of the print head 18*a* is completed. The wiper 111*b* is in a "set" state: that is, a state in which the wiper 111*b* can wipe the print head 18*b*.

Figure 8:
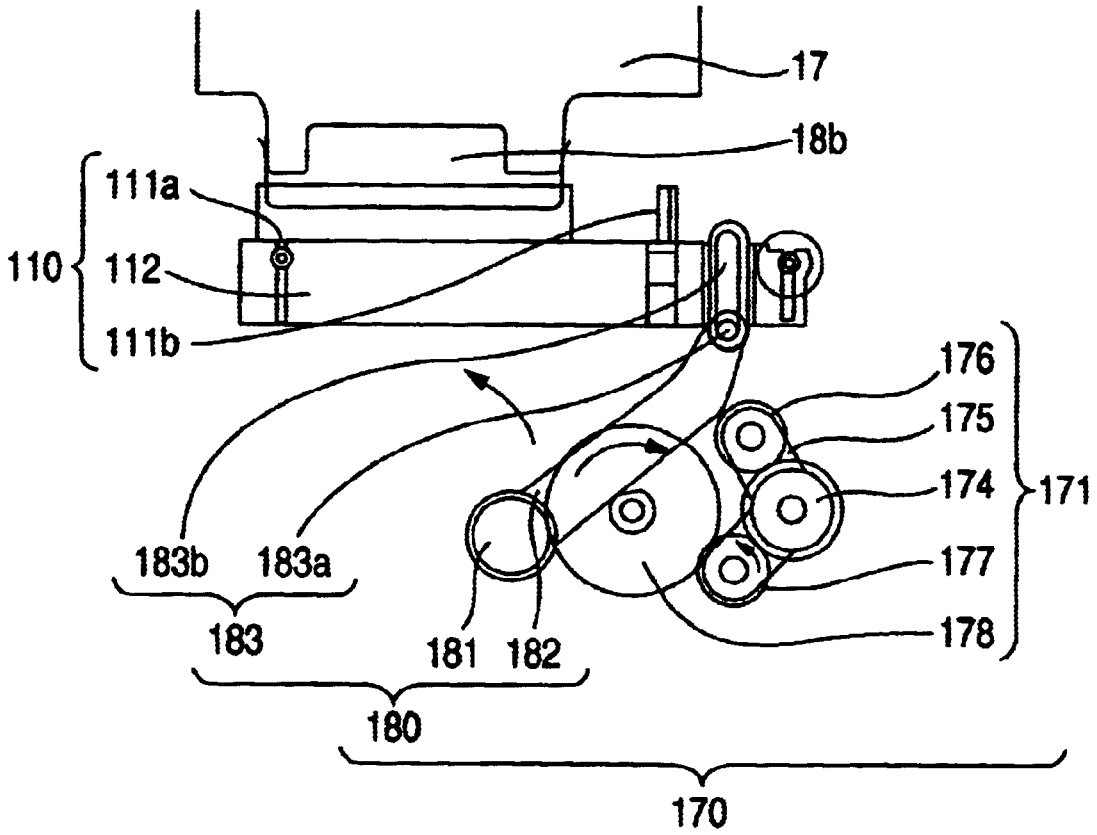
Figure 9:
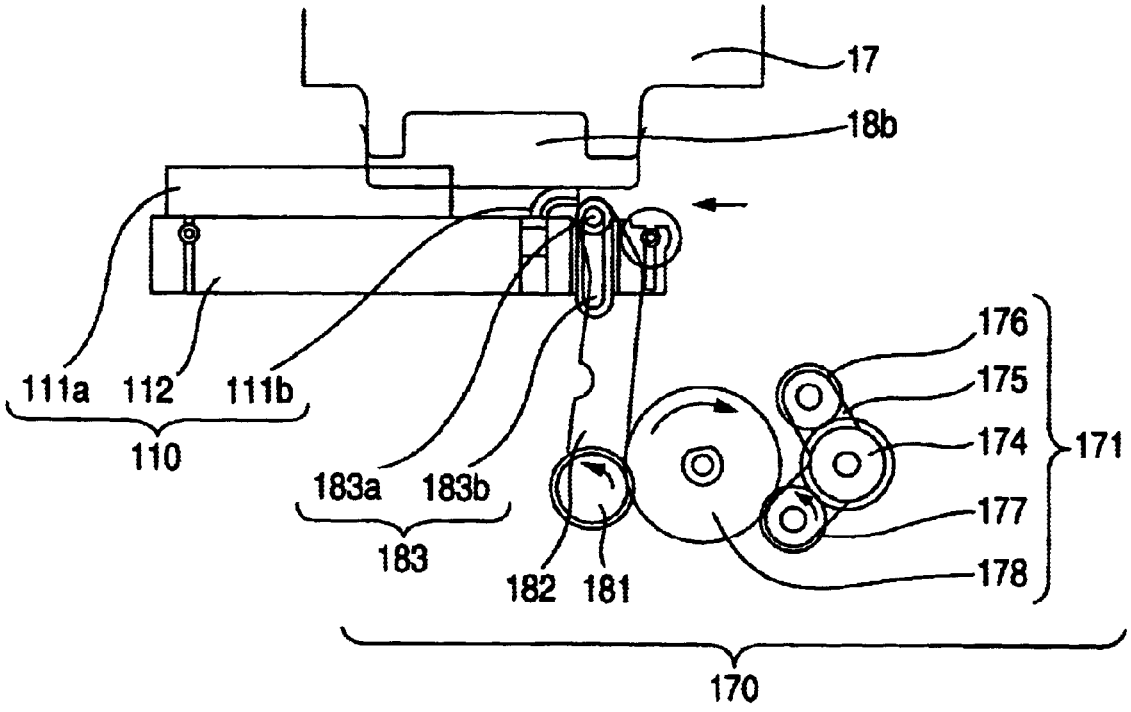

In this state, when the motor is rotated reversely to thereby rotate the planetary lever 175, the reverse rotation planetary gear 177 meshes with the second partially-chipped gear 178*b* as shown in FIG. 8. The torque of the sun gear 174 is transmitted from the reverse rotation planetary gear 177 to the second partially-chipped gear 178*b* and from the third partially-chipped gear 178*c* to the wiper gear 181. As a result, the lever 182 turns, whereby the cam mechanism 183 causes the wiper holder 112 to start moving in the leftward direction in the drawing. As shown in FIG. 9, the wiper 111*b* wipes the nozzle formation face of the print head 18*b*.

Figure 10A:
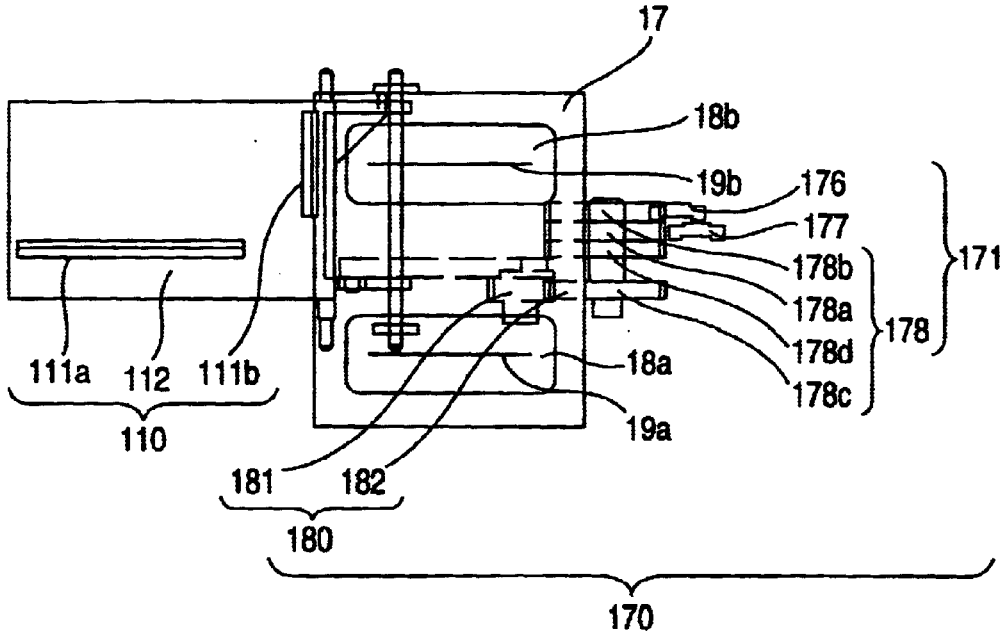
Figure 10B:
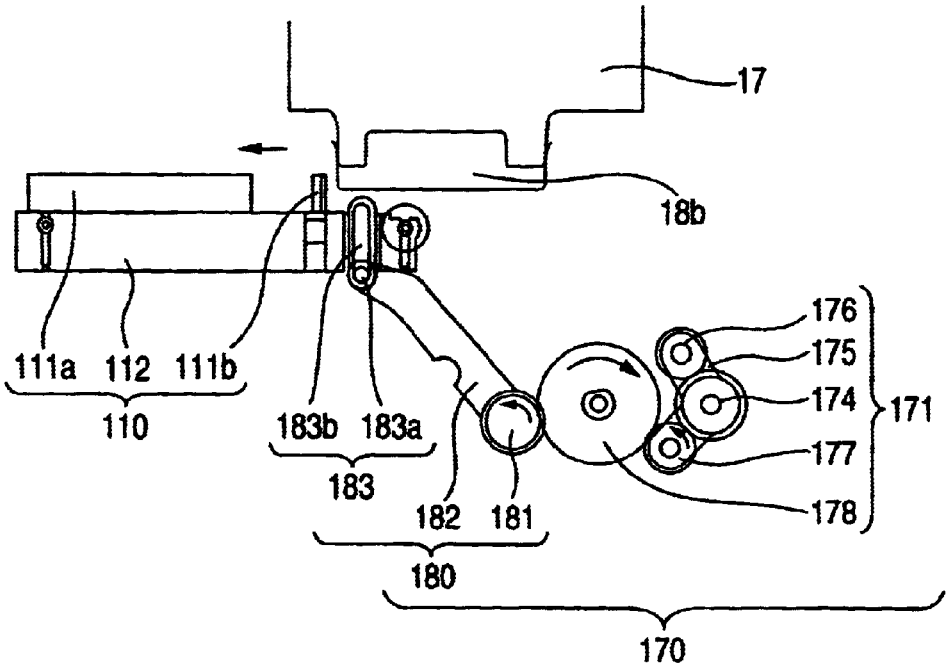

When a cog-chipped portion of the third partially-chipped gear 178*c* reaches the wiper gear 181, to thereby release the gear from a meshed state, the wiper gear 181 idly rotates. As shown in FIG. 10, the wiper holder 112 stops moving. At this time, the wiping unit 110 is situated in the leftmost position in the drawing, and the wiper 111*b* is in a "reset" state: that is, a state in which wiping of the print head 18*b* has been completed.

Although the foregoing embodiment has described the ink ejectability maintenance device 100 having the wiping unit 110, even an ink ejectability maintenance device provided with a capping unit and a suction unit can be constructed in the same manner and attain the same advantages. The embodiment has described the invention by taking an ink jet printer as an example, the invention can be applied to, e.g., a facsimile apparatus or a copier incorporating such an ink jet type recording head.

What is claimed is:

1. An ink ejectability maintenance device for maintaining an ink ejectability of at least one recording head which ejects ink droplets to a recording medium, comprising:

a first wiper, which wipes a nozzle formation face of the recording head in a first direction; and a second wiper, which wipes the nozzle formation face in a second direction which is different from the first direction.

2. The ink ejectability maintenance device as set forth in claim 1, wherein the first direction is a direction in which the recording head reciprocately moves, and the second direction is a direction in which the recording medium is fed.

3. The ink ejectability maintenance device as set forth in claim 1, wherein the first wiper and the second wiper are disposed on a single base member.

4. The ink ejectability maintenance device as set forth in claim 3, further comprising a driver unit which moves the single base member only in the second direction.

5. The ink ejectability maintenance device as set forth in claim 4, wherein the driver unit includes a pair of planetary gears which transmits a driving force thereof to the base member, and a single rotor which rotates either one of the planetary gears so that the driving force is transmitted by both of a forward rotation and a reverse rotation thereof.

6. The ink ejectability maintenance device as set forth in claim 4, wherein:

the driver unit includes a sun gear meshed with the respective planetary gears and a partially-chipped gear connected to the base member; and the partially-chipped gear includes a cog portion which meshes either one of the planetary gears when the base member is moved, and a cogless portion which faces either one of the planetary gears after the base member is moved.

7. The ink ejectability maintenance device as set forth in claim 6, wherein the partially-chipped gear is a four-gears unit which respectively meshes the respective planetary gears and a wiper gear for driving the base member.

8. The ink ejectability maintenance device as set forth in claim 7, wherein the wiper gear includes a lever for moving the base member in the second direction and a cam mechanism connected to the lever.

9. The ink ejectability maintenance device as set forth in claim 1, wherein the first wiper extends in a direction which is slightly angled from the second direction, and the second wiper extends in a direction which is slightly angled from the first direction.

10. The ink ejectability maintenance device as set forth in claim 1, wherein:

the at least one recording head includes a plurality of recording heads which are arranged in the first direction; and each nozzle formation face is wiped by either one of the first wiper and the second wiper selectably.

11. A recording apparatus comprising the ink ejectability maintenance device as set forth in any one of claims 1 to 8.

* * * * *